US005876027A

United States Patent [19]

Fukui et al.

[11] Patent Number: 5,876,027

[45] **Date of Patent: *Mar. 2, 1999**

[54] SHEET BUNDLE FOLDING APPARATUS

[75] Inventors: Akira Fukui, Tokyo; Yoshihiko Kitahara, Yokohama, both of Japan

[73] Assignee: Canon Aptex Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 662,308

[22] Filed: Jun. 13, 1996

[30] Foreign Application Priority Data

Jun. 15, 1995 [JP] Japan ..... 7-149094
Dec. 28, 1995 [JP] Japan ..... 7-344059

[51] Int. Cl.[6] ..... B42C 1/10

[52] U.S. Cl. ..... 270/51; 270/58.11; 493/437; 493/444; 493/445

[58] Field of Search ..... 270/45, 51, 58.01, 270/58.07, 58.08, 58.09, 58.11; 493/23, 29, 437, 444, 445

[56] References Cited

U.S. PATENT DOCUMENTS

| | | | |
|---|---|---|---|
| 4,908,010 | 3/1990 | Yoshioka | 493/357 |
| 5,082,255 | 1/1992 | Brigante et al. | 270/45 |
| 5,090,671 | 2/1992 | Gombault et al. | 270/45 |
| 5,169,376 | 12/1992 | Reis et al. | 493/445 |
| 5,377,965 | 1/1995 | Mandel et al. | 270/37 |

FOREIGN PATENT DOCUMENTS

| | | |
|---|---|---|
| 0 498168 | 8/1992 | European Pat. Off. . |
| 4-333469 | 11/1992 | Japan . |

*Primary Examiner*—Hoang Nguyen
*Attorney, Agent, or Firm*—Fitzpatrick, Cella, Harper & Scinto

[57] ABSTRACT

A sheet bundle folding apparatus causes a bundle of sheets to be rolled into a pair of fold rollers thereby folding the bundle of sheets. The apparatus is provided with a drive source for rotating the pair of fold rollers in a normal direction to roll in the bundle of sheets and in a reverse direction to return the rolled-in bundle of sheets.

20 Claims, 10 Drawing Sheets

SHEET BUNDLE FOLDING APPARATUS

BACKGROUND OF THE INVENTION

1. Field of the Invention

This invention relates to a sheet folding apparatus for folding a bundle of sheets, and an image forming apparatus such as a copying apparatus, a printer or a facsimile apparatus provided with the sheet bundle folding apparatus, and more particularly relates to a sheet bundle folding apparatus for folding a bundle of sheet by a pair of folding rollers and an image forming apparatus provided with the same.

2. Related Background Art

As a sheet bundle folding apparatus mounted on an image forming apparatus such as a printer or a facsimile apparatus, as described, for example, in Japanese Patent Laid-Open Application No. 4-333469. This is provided with two sets of roller pairs, i.e., a pair of pre-fold rollers for folding a bundle of sheets after image formation and a pair of pressing rollers, and a folding bar for pushing the bundle of sheets into the nip between the pair of pre-fold rollers.

In the sheet bundle folding apparatus of such a construction, is shown for example in, the bundle of sheets after image formation is conveyed upwardly of the pair of pre-fold rollers, whereafter as shown in FIG. 17 of the accompanying drawings, the folding bar 1 is protruded toward the pair of pre-fold rollers 2 (e.g. downwardly). When the folding bar 1 is thus protruded downwardly, the central portion of the bundle of sheets 3 is pushed into the nip 2*a* between the pair of pre-fold rollers 2 rotated in the roll-in direction indicated by an arrow, by the folding bar 1, whereby the bundle of sheets 3 is enfolded from the central portion thereof by the pair of pre-fold rollers 2 and is folded into two.

Thereafter, the bundle of sheets 3 folded into two by the pair of pre-fold rollers 2 is rolled into a pair of pressing rollers 2A disposed below the pair of pre-fold rollers 2, and is further pressed by this pair of pressing rollers 2A and is neatly folded into two.

Now, in such a sheet bundle folding apparatus according to the prior art, the fold height of the folded bundle of sheets 3 and the drive torque for the pair of rollers required for folding are in an inverse proportional relation and therefore, a great drive torque will become necessary if an attempt is made to make the fold height low. For example, to neatly fold a sheet of A3 size (80 g/m$^2$) into a sheet of A4 size so that the fold height when it is placed on a flat surface may be of the order of 30 mm, a great drive torque of the order of 25 kg/cm becomes necessary as the drive torque for the pressing rollers.

To produce such a great drive torque, a large drive device becomes necessary, but there has been the problem that an attempt to provide such a large drive device leads to the bulkiness of the entire sheet bundle folding apparatus, which in turn leads to the bulkiness of the image forming apparatus.

Also, the apparatus according to the prior art, as described above, is designed such that sheet folding is effected by the two sets of a roller pairs, i.e., the pair of pre-fold rollers and the pair of pressing rollers and therefore, a drive device becomes necessary for each of the roller pairs, and this has led to the problem of complicated structure.

SUMMARY OF THE INVENTION

The present invention has been made in view of the above-noted circumstances and a first object thereof is to provide a sheet bundle folding apparatus capable of neatly folding a bundle of sheet even by a drive device of small drive torque, and an image forming apparatus provided with the same.

A second object of the present invention is to provide a sheet bundle folding apparatus which is simple, compact in structure and an image forming apparatus provided with the same.

A sheet bundle folding apparatus for causing a bundle of sheets to be rolled into a pair of fold rollers and folding the bundle of sheets is provided with drive means for rotating the pair of fold rollers in a roll-in direction to roll in the bundle of sheets and a return direction to return the bundle of sheets, and particularly is provided with sheet bundle fold control means for controlling the drive means so that the pair of fold rollers may be rotated so as to roll in the bundle of sheets, and thereafter once return it, and again roll in the bundle of sheets, and on the other hand, controlling protrude means so as to protrude a folding piece from a supporting table when the pair of fold rollers are rotated in the roll-in direction, and to retract the folding piece from the supporting table when the pair of fold rollers are rotated in the return direction.

Also, the sheet bundle fold control means controls the pressure contact force so as to be of an ordinary magnitude when the pair of folding rollers is rotated in the roll-in direction and controls the pressure contact force so as to become great when the pair of folding rollers is rotated in the return direction. Particularly, the pair of fold rollers are comprised of a fixed roller and a pivotally movable moving roller brought into pressure contact with the fixed roller, and the sheet bundle fold control means is provided with pivotally moving means for pivotally moving the moving roller so as to change the pressure contact force thereof with the fixed roller.

Further, position detecting means for detecting the arrival of the rolled-in bundle of sheets at a predetermined position is provided near the pair of fold rollers, and the pair of fold rollers are rotated in the return direction on the basis of a detection signal from the position detecting means. Also, the present invention can likewise be applied to an image forming apparatus provided with an image forming unit and a sheet bundle folding apparatus for folding a bundle of sheets on which images have been formed by the image forming unit.

On the basis of the above-described construction, the pair of fold rollers are rotated so as to roll in the bundle of sheets, and thereafter once return the bundle of sheets, and again roll in the bundle of sheets.

Before the pair of fold rollers are rotated in the roll-in direction, the folding piece protrudes from the supporting table and thus, the bundle of sheets placed on the supporting table is rolled in by the pair of fold rollers. Also, when the pair of fold rollers are rotated in the return direction, the folding piece is retracted from the supporting table.

Further, when the pair of fold rollers are rotated in the roll-in direction, the pressure contact force between the two rollers constituting the pair of fold rollers assumes an ordinary magnitude whereby the rolling-in of the bundle of sheets becomes easy. On the other hand, when the pair of fold rollers are rotated in the return direction, the pressure contact force becomes great, whereby the bundle of sheet can be neatly folded.

Also, the pair of fold rollers are comprised of a fixed roller and a pivotally movable moving roller brought into pressure contact with the fixed roller, and the moving roller is pivotally moved by pivotally moving means, whereby the pressure contact force of the moving roller can be changed.

Further, the arrival of the rolled-in bundle of sheets at a predetermined position is detected by the position detecting means provided near the pair of fold rollers, and the sheet bundle fold control means rotates the pair of fold rollers in the return direction on the basis of a detection signal outputted from the position detecting means.

As described above, according to the present invention, the pair of fold rollers can be rotated so as to roll in the bundle of sheets, and thereafter once return it, and again roll in the bundle of sheets, to thereby apply folding pressure to the bundle of sheets a number of times. Therefore, the folding of the bundle of sheets can be effected by a pair of rollers and thus, the structure can be simplified.

Also, when the pair of fold rollers are rotated in the roll-in direction, the folding pressure of the pair of fold rollers can be made small to thereby make the rolling-in of the bundle of sheets easy, and when the pair of fold rollers are rotated in the return direction, the folding pressure can be made great to thereby fold the bundle of sheets neatly even by a drive device of small drive torque.

Also, in the case of a thick sheet, it is folded a number of times or the frequency of folding is increased, whereby the accuracy of folding can be enhanced. On the other hand, in the case of a sheet of a predetermined thickness or less, a number of times of folding is not effected or the frequency of folding is decreased and therefore, it becomes possible to enhance productivity. This is because when the thickness of a bundle of sheets (the number of sheets) is less, the returning operation is not performed or the frequency of folding is less and therefore there is less waste of time.

Further, by such a sheet bundle folding apparatus being applied to an image forming apparatus, a bundle of sheet can be folded neatly even by a compact drive device of small drive torque.

BRIEF DESCRIPTION OF THE DRAWINGS

FIGS. 14A to 14F are operational illustrations showing the procedures of sheet folding apparatus according to another embodiment of the present invention, among which FIG. 14A is a first operational illustration, FIG. 14B is a second operational illustration, FIG. 14C is a third operational illustration, FIG. 14D is a fourth operational illustration, FIG. 14E is a fifth operational illustration, and FIG. 14F is a sixth operational illustration.

DESCRIPTION OF THE PREFERRED EMBODIMENTS

Some embodiments of the present invention will hereinafter be described with reference to the drawings.

Figure 1:
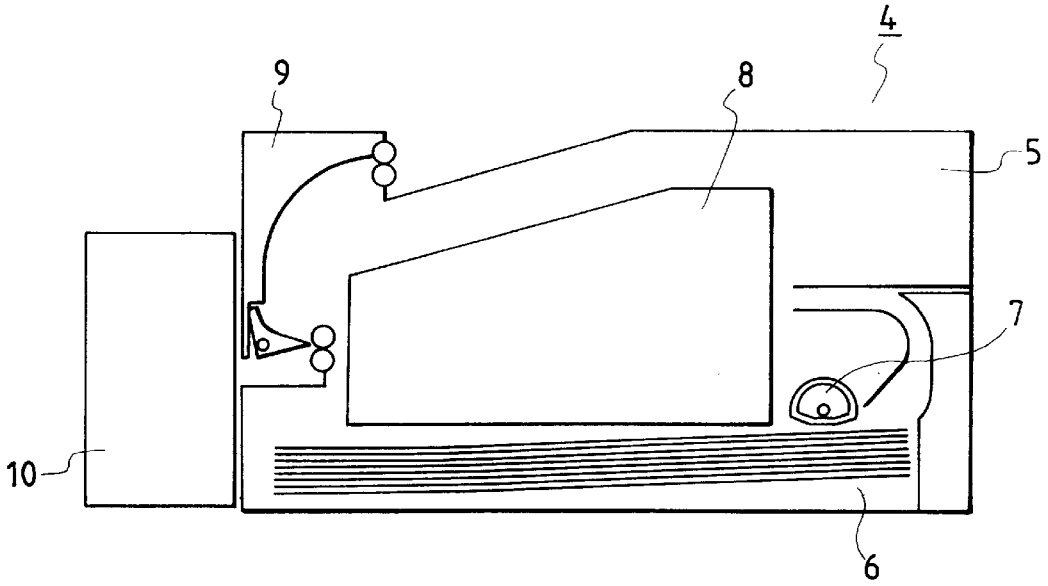
FIG. 1 is a schematic view showing the entirety of an image forming apparatus according to the present invention.

An image forming apparatus 4, as shown in FIG. 1, is provided with a paper supply cassette 6 removably mounted in a main body 5 of the image forming apparatus (refer simply "apparatus body" hereinafter), a paper feeding roller 7, an image forming unit 8 and a sheet discharge device 9. This image forming apparatus 4 may specifically be a printer, a copying apparatus or a facsimile apparatus, and the image forming unit 8 may be of the optical type, the electrostatic type, the impact type, the laser beam type, the ink jet type or the thermal type.

On the other hand, a sheet bundle folding apparatus 10 is mounted, for example, on one side of the apparatus body. This sheet bundle folding apparatus 10, as shown in FIG. 2, has a supporting table 11 supporting thereon a bundle of sheets (not shown in FIG. 2) having images formed thereon and discharged from a direction indicated by arrow, by a sheet discharge device 9, a fold roller pair 14 comprised of a pair of rollers 12 and 13 disposed above the supporting table 11 and urged against each other, a folding bar 16 which is a folding piece disposed below the supporting table 11 and is protruded to the supporting table 11 when the bundle of sheets is to be folded to thereby guide the bundle of sheets placed on the supporting table 11 to the nip portion (the pressure contact portion) 15 of the fold roller pair 14, a protruding device 17 which is protruding means for protruding the folding bar 16, and a pressure adjusting device 18 which is pressure force changing means for changing the pressure contact force of the rollers 12 and 13 which is the folding pressure of the fold roller pair 14.

Figure 2:
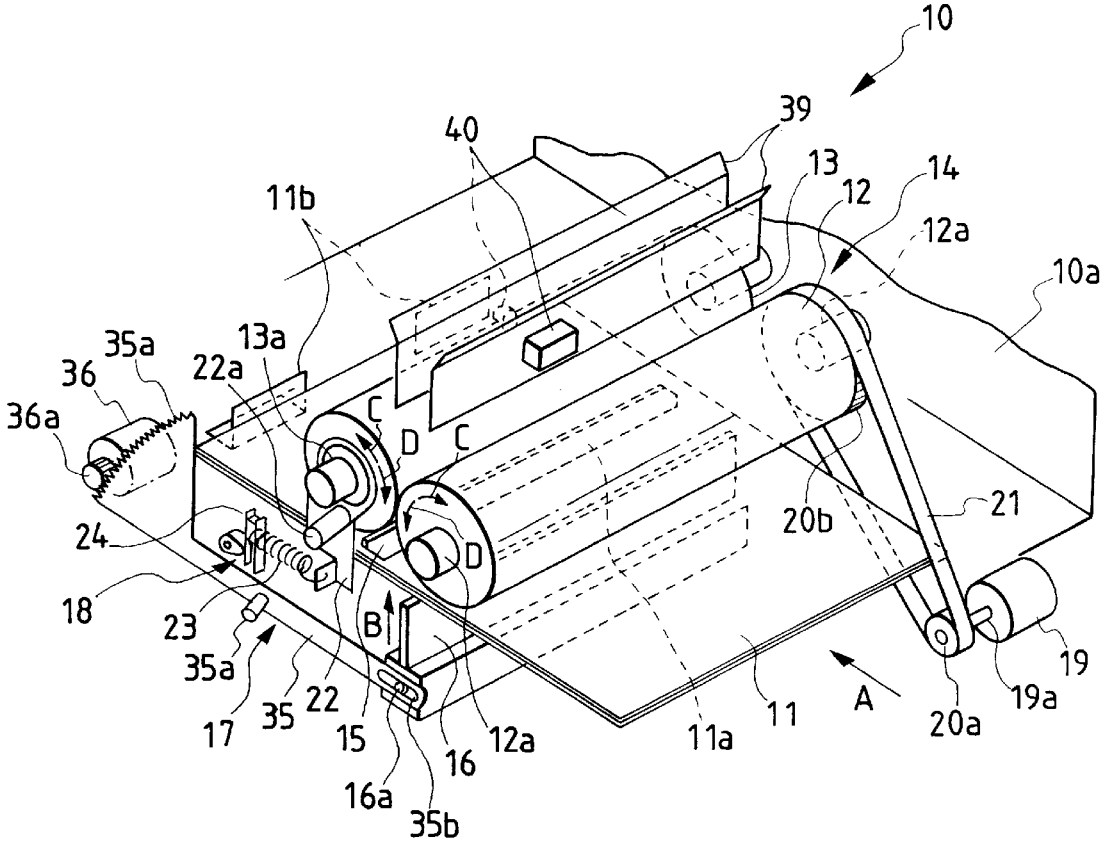
FIG. 2 is a perspective view showing the internal structure of a sheet bundle folding apparatus disposed in the image forming apparatus of FIG. 1.

In FIG. 2, the reference character 11*a* designates a slot formed in the supporting table 11 in the lengthwise direction of the rollers 12 and 13, and the folding bar 16 is adapted to pass through this slot 11*a* and protrude to the supporting table 11. Also, stoppers 11*b* are provided on one end portion of the supporting table 11 so that the bundle of sheets discharged may be stopped by the stoppers 11*b* at a position whereat the center of fold thereof faces the slot 11*a*. Thus, when the folding bar 16 is protruded, the bundle of sheets is adapted to be pushed up by the folding bar 16 as an angled shape with the center as the vertex.

Now, one roller (hereinafter referred to as the "first roller") 12 which is the fixed roller of the fold roller pair is rotatably held by the frame 10*a* of the sheet bundle folding apparatus 10 and a frame (not shown) on this side opposed to the frame 10*a* through bearings (not shown) and is adapted to be rotatively driven by a normally and reversely rotatable fold motor 19 which is a drive means.

The first roller 12 is adapted to be normally rotated when for example, the fold motor 19 is normally rotated, and when the first roller 12 is thus normally rotated, the other roller (hereinafter referred to as the "second roller") 13 which is a pivotally movable moving roller urged against the first roller 12 is reversely rotated. When the first roller 12 is normally rotated and the second roller 13 is reversely rotated as described above, the fold roller pair 14 is rotated in a roll-in direction and thus, the bundle of sheets guided to the nip portion 15 by the folding bar 16 is rolled into the fold roller pair 14.

Also, design is made such that when the fold motor 19 is reversely rotated, the first roller 12 is reversely rotated, and when the first roller 12 is thus reversely rotated, the second roller 13 is normally rotated. Accordingly, when the fold motor 19 is normally rotated to thereby roll in the bundle of sheets and thereafter the fold motor 19 is reversely rotated, the first roller 12 is reversely rotated and the second roller 13 is normally rotated. Thus, the fold roller pair 14 is rotated in the return direction, whereby the rolled-in bundle of sheets is liberated from the fold roller pair 14 and is returned onto the supporting table 11.

In FIG. 2, the reference character 20*a* denotes a first pulley mounted on the rotary shaft 19*a* of the fold motor 19, the reference character 20*b* designates a second pulley mounted on the rotary shaft 12*a* of the first roller 12, and the reference numeral 21 denotes a belt passed over these two pulleys 20*a* and 20*b*. The rotation of the fold motor 19 may be transmitted to the first roller 12 through the first pulley 20*a*, the second pulley 20*b* and the belt 21. On the other hand, the second roller 13 is rotatably held on the upper end portion of a pressing plate 22 pivotally mounted on the frame on this side through a pivotally movable shaft 22*a*, through a bearing. The reference character 13*a* designates the rotary shaft of the second roller 13.

The second roller 13 is thus held by the pivotally movable pressing plate 22, whereby even if the second roller 13 is in pressure contact with the first roller 12 when the bundle of sheets passes through the nip portion 15, the second roller 13 is pushed by the bundle of sheets and becomes movable away from the first roller 12 and thus, the bundle of sheets can pass through the nip portion 15 of the folding roller pair 14 without being jammed.

Figure 3:
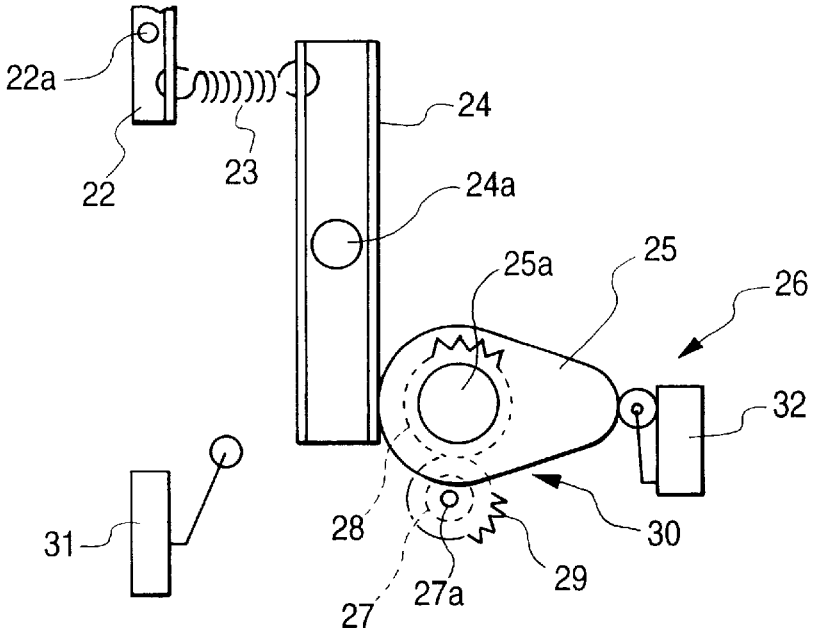
FIG. 3 is an illustration showing the structure of the pressure adjusting device of the sheet bundle folding apparatus of FIG. 2.

Now, the pressing plate 22 is connected to the pressure adjusting device 18 by a coil spring 23. This pressure adjusting device 18 pivotally moves the second roller 13 through the pressing plate 22 to thereby change the pressure contact force of the second roller 13 to a first pressure contact force or a second pressure contact force as will be described later. The device 18 is provided with the coil spring 23, a pressure varying plate 24 pivotally mounted on the frame on this side through a pivotally movable shaft 24*a* and having one end of the coil spring 23 restrained thereon, as shown in FIG. 3, and a pivotally moving mechanism 26 for pivotally moving the pressure varying plate 24 by a cam 25. The pivotally moving mechanism 26 and the pressure varying plate 24 together constitute pivotally moving means for pivotally moving the second roller 13, and when the pressure varying plate 24 is pivotally moved by the pivotally moving mechanism 26, the pressing plate 22 having the other end of the coil spring 23 restrained thereon as shown in FIG. 4 may be pulled and pivotally moved by the coil spring 23.

Figure 4:
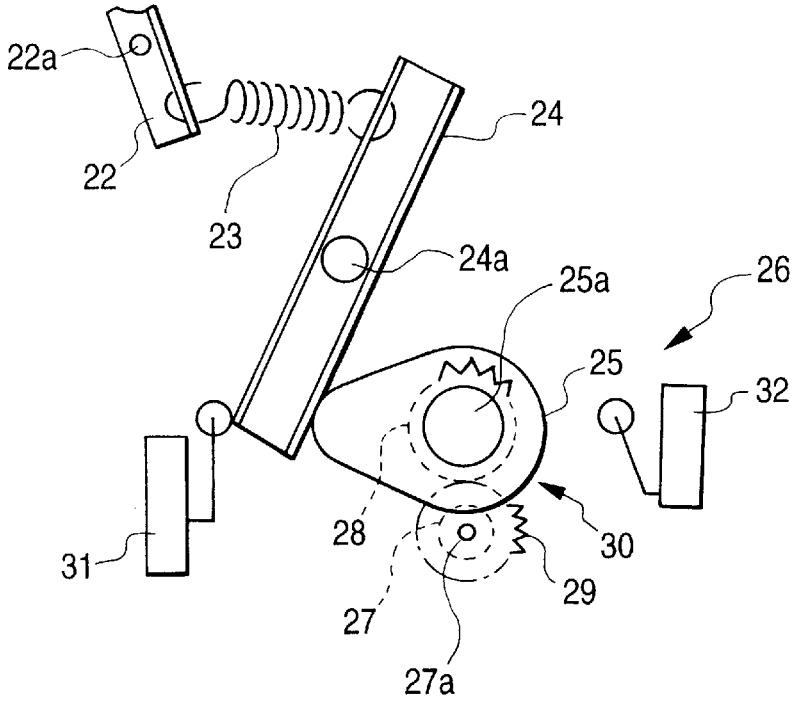
FIG. 4 is an illustration showing the manner in which a pressing plate is pivotally moved by the pressure adjusting device of FIG. 3.

In the present embodiment, as shown in FIG. 4, one end of the coil spring 22 is restrained on the upper end of the pressure varying plate 24 and the other end of the coil spring 22 is restrained on the lower end of the pressing plate 22 which is near the pressure varying plate 24. By the coil spring 23 being mounted in such a relation, when as will be described later, the pressure varying plate 24 is pivotally moved in a direction to pull the coil spring 23 by the cam 25, the pressing plate 22 is pulled by the coil spring 23 and is pivotally moved in a direction to bring the second roller 13 close to the first roller 12 side (hereinafter referred to as the "first roller direction").

When the pressing plate 22 is thus pivotally moved in the first roller direction and the second roller 13 comes close to the first roller 12, the pressure contact force of the second roller 13 against the first roller 12 becomes greater than the ordinary pressure contact force (hereinafter referred to as the "first pressure contact force") when the pressing plate 22 is not pivotally moved. By such a great pressure contact force (hereinafter referred to as the "second pressure contact force"), the second roller 13 is brought into pressure contact with the first roller 12, whereby great folding pressure can be applied to the bundle of sheets passing through the nip portion 15. By such great folding pressure being applied, the manner in which the bundle of sheets is folded can be improved.

Now, the pivotally moving mechanism 26 for pivotally moving the pressure varying plate 24 has the cam 25, a normally and reversely rotatable cam motor 27, a gear device 30 comprising a cam gear 28 mounted on a cam shaft 25*a* and a motor gear 29 mounted on the rotary shaft 27*a* of the cam motor 27 and meshing with the cam gear 28, and a first switch 31 and a second switch 32 for controlling the driving of the cam motor 27.

The cam 25 is rotated by the rotation of the cam motor 27 transmitted thereto through the gear device 30 and presses the lower end portion of the pressure varying plate 24 to thereby pivotally move it in a direction to pull the coil spring 23, as shown in FIG. 24. When the pressure varying plate 24 is pivotally moved, the pressing plate 22 is pivotally moved in the first roller direction therewith.

When the pressing plate 22 is pivotally moved to a first predetermined position in which the second roller 13 can be brought into pressure contact with the first roller 12 by the second pressure contact force, the lower end portion of the pressure varying plate 24 pushes the first switch 31 as shown in FIG. 4. Thus, the first switch 31 outputs a signal indicative of the fact that the pressing plate 22 has been pivotally moved to the first predetermined position to a control device which will be described later.

On the other hand, when the pressing plate 22 is to be returned from the first predetermined position to the normal position before the pivotal movement, that is, the pressure contact force of the second roller 13 is to be returned from the second pressure contact force to the first pressure contact force, the cam motor 27 is driven to thereby reversely rotate the cam 25. Thereby, the pressure force of the cam 25 to the pressure varying plate 24 becomes null and thus, the pressure varying plate 24 and the pressing plate 22 are returned to their respective normal positions before the pivotal movement by the constrictive force of the coil spring 23, and the second roller 13 is brought into pressure contact with the first roller 12 with the first pressure contact force.

When the cam 25 is rotated to a position in which the pressing plate 22 is returned to the normal position, it pushes the second switch 32, as shown in FIG. 3, and the second switch outputs to the control device a signal indicative of the return of the pressing plate 22 to the normal position.

On the other hand, the protruding device 17 for protruding the folding bar 16, as shown in FIG. 2, is provided with a protrude arm 35 holding the folding bar 16 on one end portion thereof and having a curved rack 35*a* formed on the other end thereof, and a normally and reversely rotatable protrude motor 36 having mounted thereon a pinion 36*a* meshing with the rack 35*a*. The protrude arm 35 is pivotally held on the frame on this side through a pivotally movable shaft 35*a*. The folding bar 16 is mounted on the protrude arm 35 with a shaft 16*a* which is formed on the lower end of the folding bar loosely fitted in a laterally long slot 35*b* formed in one end portion of the protrude arm 35. By the shaft 16*a* being thus loosely fitted in the slot 35*b*, when the protrude arm 35 is pivotally moved, the folding bar 16 can always keep a predetermined protruding posture while sliding the shaft 16*a*.

On the lower surface of the supporting table 11, there is provided a guide member (not shown) for guiding the protrusion of the folding bar 16 adapted to be protruded in the direction of arrow B indicated in FIG. 2, and when it is to be protruded, the folding bar 16 is protruded always in a vertical state while being guided by the guide member, whereby it can reliably guide the bundle of sheets to the nip portion 15.

Now, when an operating button 37 shown in FIG. 5 which will be described later and which is provided to start the sheet bundle folding apparatus 10 is depressed, the protrude motor 36 is normally rotated for a first predetermined time in conformity with a drive signal from the control device to thereby pivotally move the protrude arm 35 in a direction to protrude the folding bar 16 (hereinafter referred to as the "protrude direction"). This first predetermined time is a time during which the folding bar 16 can reliably cause the bundle of sheets to be rolled into the fold roller pair 14 and can be protruded by such a distance that it does not strike against the fold roller pair 14. Also, the protrude motor 36 is designed to be reversely rotated for the same predetermined time in conformity with a drive signal from the control device after it has been normally rotated for the first predetermined time. Thus, the protrude arm 35 is pivotally moved in a direction to retract the folding bar 16 (hereinafter referred to as the "retract direction").

Figure 5:
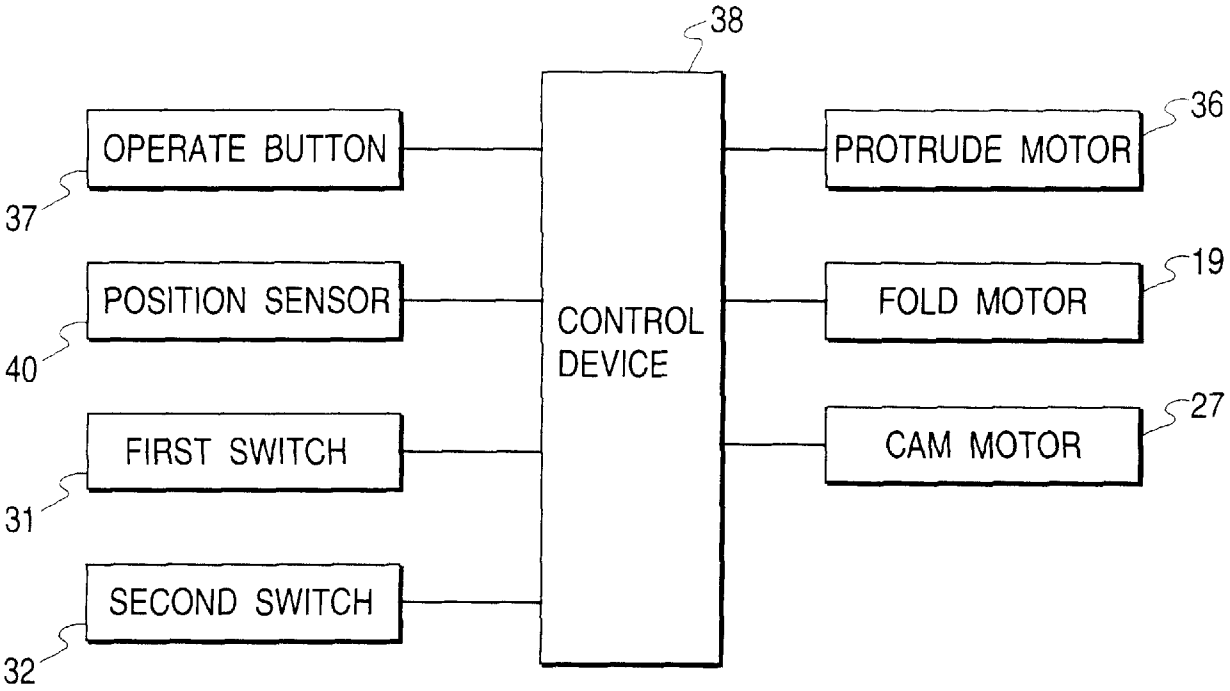
FIG. 5 is a block diagram of the control device of the sheet bundle folding apparatus.

On the other hand, at a predetermined location in the sheet bundle folding apparatus 10, there is disposed a control device 38 which is control means for driving and controlling the fold motor 19, the cam motor 27 and the protrude motor 36 to thereby control the sheet bundle folding operation, as shown in FIG. 5, when the operate button 37 is depressed.

As shown in FIG. 2, a position sensor 40 which is position detecting means is disposed in a paper discharge path 39 provided near the fold roller pair 14, and in the present embodiment, above the fold roller pair 14. This sensor is for detecting that the bundle of sheets raised up after rolled in by the fold roller pair 14 has been raised to a second predetermined position in which it does not slip off the fold roller pair 14, and is comprised of a photosensor or the like. The detection signal from this position 40 is inputted to the control device 38.

When the operate button 37 is depressed, the control device 38 firstly outputs a drive signal to the protrude motor 36 and the fold motor 19 to thereby normally rotate the protrude motor 36 for the first predetermined time and normally rotate the fold motor 19. When the protrude motor 36 is thus normally rotated for the first predetermined time, the protrude arm 35 is pivotally moved in the protrude direction, whereby the folding bar 16 is protruded from the supporting table 11 and the bundle of sheets placed on the supporting table 11 is guided to the nip portion 15 of the fold roller pair 14. Also, when the fold motor 19 is normally rotated, the fold roller pair 14 is rotated in the roll-in direction and the bundle of sheets guided by the folding bar 16 is rolled in.

When the bundle of sheets is to be thus rolled in, the control device 38 does not output a drive signal to the cam motor 27, whereby the second roller 13 is brought into pressure contact with the first roller 12 with a first pressure contact force. The bundle of sheet is rolled into the fold roller pair 14 being in pressure contact with such small first pressure contact force, whereby the bundle of sheets can be easily rolled in even if the torque of the fold motor 19 is small and therefore, the fold motor 19 can be made compact.

Also, when the first predetermined time elapses, the control device 38 stops the protrude motor 36, while the rolled-in bundle of sheets is raised to a second predetermined position. When the detection signal from the position sensor 40 which has detected this is inputted to the control device 38, the control device 38 stops the fold motor 19 and outputs a drive signal to the protrude motor 36 and the cam motor 27 to thereby reversely rotate the protrude motor 36 for the first predetermined time and normally rotate the cam motor 27.

When the protrude motor 36 is thus reversely rotated for the first predetermined time, the protrude arm 35 is pivotally moved in the retract direction and the folding bar 16 is retracted downwardly of the supporting table 11. When the cam motor 27 is normally rotated, the cam 25 presses the lower end portion of the pressure varying plate 24, whereby the pressure varying plate 24 is pivotally moved in a direction to pull the coil spring 23. When the pressure varying plate 24 is thus pivotally moved, the pressing plate 22 is pulled by the coil spring 23 and is pivotally moved to a first predetermined position, and the second roller 13 is brought into pressure contact with the first roller 12 with a second pressure contact force.

When the pressure varying plate 24 pushed by the cam 25 is pivotally moved to thereby push the first switch 31, the first switch 31 outputs to the control device 38 a signal indicative of the fact that the pressing plate 22 has been pivotally moved to the first predetermined position. On the basis thereof, the control device 38 stops the cam motor 27 and the pressing plate 22 is held in the first predetermined position.

On the other hand, after the pressing plate 22 has been held in the first predetermined position, the control device 38 outputs a drive signal to the fold motor 19 to thereby reversely rotate the fold motor 19 for a second predetermined time. When the fold motor 19 is thus reversely rotated, the fold roller pair 14 is rotated in the return direction and the bundle of sheets which has so far been moved so as to be raised is lowered and is soon liberated from the folding roller pair 14 and is returned onto the supporting table. This second predetermined time is a time sufficient for the bundle of sheets to be lowered by the rotation of the fold roller pair 14 and thereafter be liberated from the folding roller pair 14 and returned onto the supporting table 11.

When the bundle of sheets is thus being lowered, the second roller 13 is in pressure contact with the first roller 12 with the second pressure contact force and therefore, when the leading end, i.e., the fold portion, of the bundle of sheets passes through the nip portion 15, greater folding pressure is applied to this fold portion. As a result, the bundle of sheets folded by the small first pressure contact force when first rolled in is folded more neatly when it is returned.

Now, after the fold motor 19 is thus reversely rotated for the second predetermined time to thereby liberate the bundle of sheets, the control device 38 outputs a drive signal to the cam motor 27 to thereby reversely rotate the cam motor 27. Thereby, the cam 25 so far stopped in a position for keeping the pressing plate 22 in the first predetermined position is reversely rotated and the pressing plate 22 is returned to its normal position by the constrictive force of the coil spring 23, and the second roller 13 comes into pressure contact with the first roller 12 with the first pressure contact force.

The cam 25 is adapted to push the second switch 32 when it is rotated to a position for returning the pressing plate 22 to its normal position, whereby the second switch 32 outputs to the control device 38 a signal indicative of the return of the pressing plate 22 to its normal position. On the basis thereof, the control device 38 stops the cam motor 27, whereby the pressing plate 22 is held in its normal position.

On the other hand, the control device 38, when the signal from the second switch 32 is inputted thereto, outputs a drive signal to the protrude motor 36 and the fold motor 19 to thereby normally rotate the fold motor 19 and normally rotate the protrude motor 36 for the first predetermined time. When the protrude motor 36 is thus normally rotated for the first predetermined time, the folding bar 16 is protruded from the supporting table 11 so that the central portion of the neatly folded bundle of sheets may be rolled into the fold roller pair 14. The neatly folded bundle of sheets is thus again rolled in, whereby the bundle of sheets can be folded more neatly.

Now, when the bundle of sheets thus rolled in is raised to the second predetermined position, the signal from the position sensor 40 is inputted to the control device 38, whereby the control device 38 outputs a drive signal to the protrude motor 36 to thereby reversely rotate the protrude motor 36 for the first predetermined time and retract the folding bar 16 downwardly of the supporting table 11. However, unlike the case where the signal from the position sensor 40 has been inputted for the first time, the control device 38 reversely rotates the protrude motor 36, but normally rotates the fold motor 19. Thereby, the bundle of sheets is neatly folded and is moved via the paper discharge path 39 to a take-out portion (not shown) formed above the paper discharge path 39, and is taken out from the take-out portion.

In the present embodiment, the control device 38 is adapted to detect that the folded bundle of sheets has been taken out by the fact that the signal from the position sensor 40 is no longer inputted, and to judge that the bundle of sheets has been taken out when the signal is no longer inputted, and stop the fold motor 19 and prepare for the next folding operation.

Figure 6:
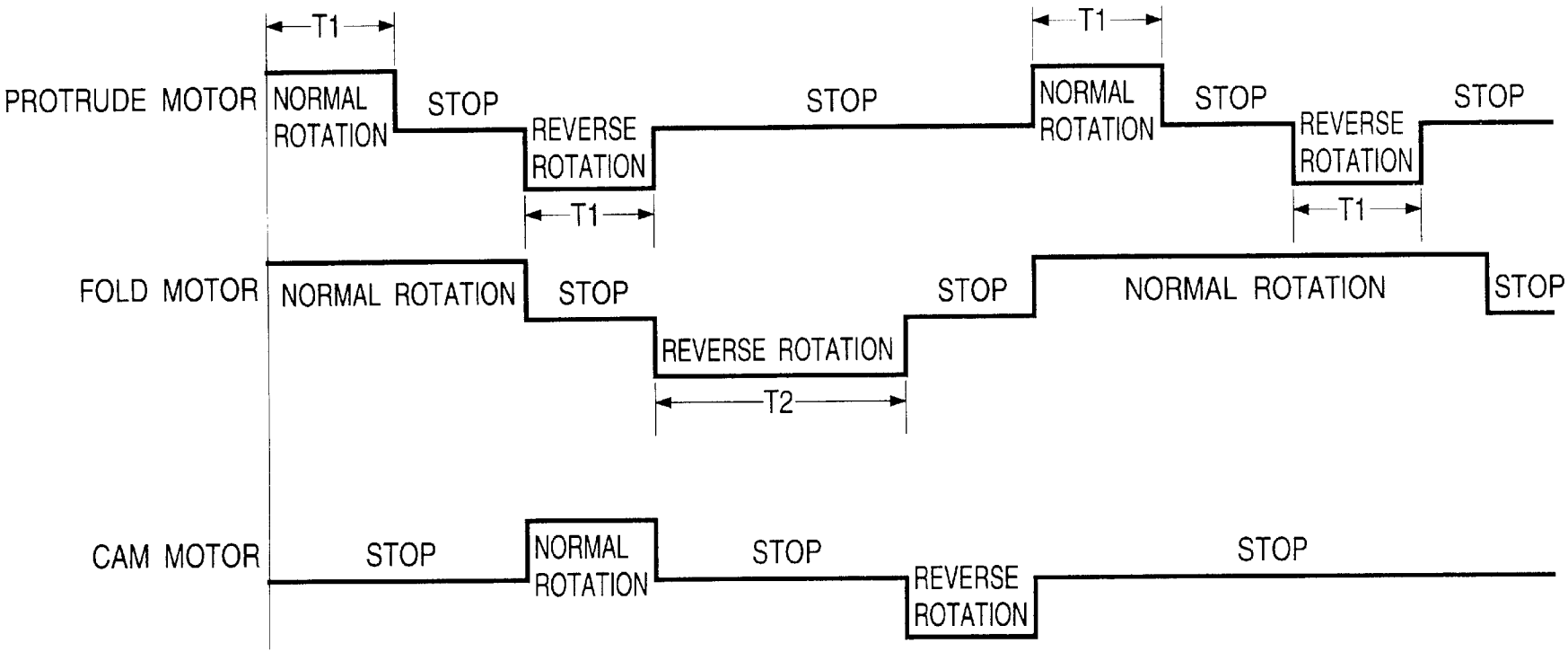
FIG. 6 is a timing chart for driving the various motors of the sheet bundle folding apparatus.

The action of the above-described embodiment will now be described with reference to a timing chart shown in FIG. 6.

Figure 7:
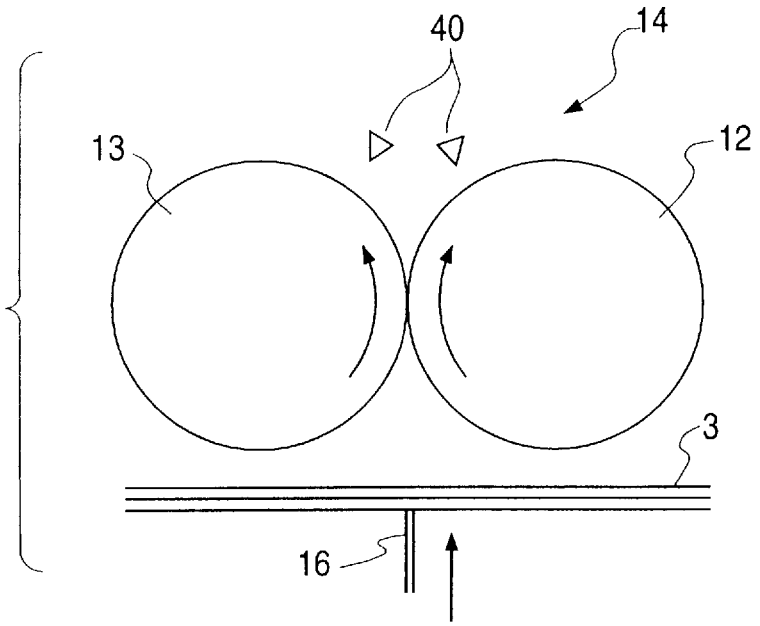
FIG. 7 is an illustration showing the manner in which the folding bar of the sheet bundle folding apparatus strikes against a bundle of sheets.
Figure 8:
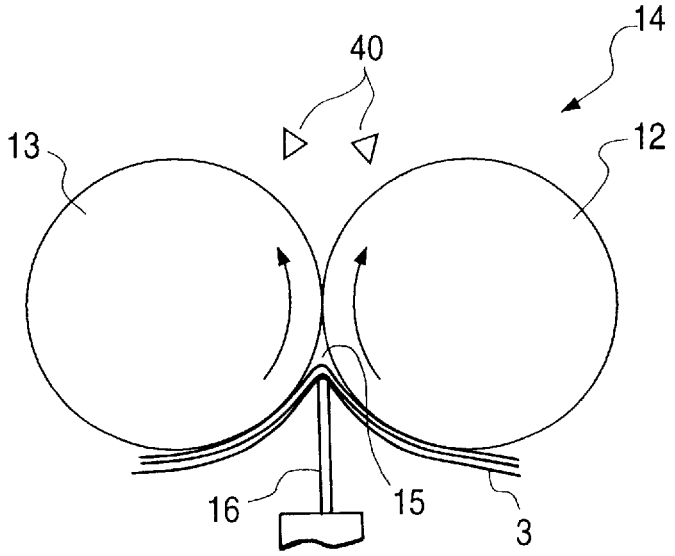
FIG. 8 is an illustration showing the manner in which the bundle of sheets is rolled in by a pair of fold rollers.

When the operate button is depressed, the control device 38 first outputs a drive signal to the protrude motor 36 and the fold motor 19 to thereby normally rotate the protrude motor 36 for the first predetermined time (T1) and normally rotate the fold motor 19. Thereby, as shown in FIG. 7, the folding bar 16 is protruded from the supporting table 11 and strikes against the bundle of sheets 3 placed on the supporting table 11. As shown in FIG. 8, by this folding bar 16, the bundle of sheets 3 is guided to the nip portion 15 of the fold roller pair 14, is rolled into the fold roller pair 14 being rotated in the roll-in direction indicated by an arrow, and is folded with the first pressure contact force at this time.

Figure 9:
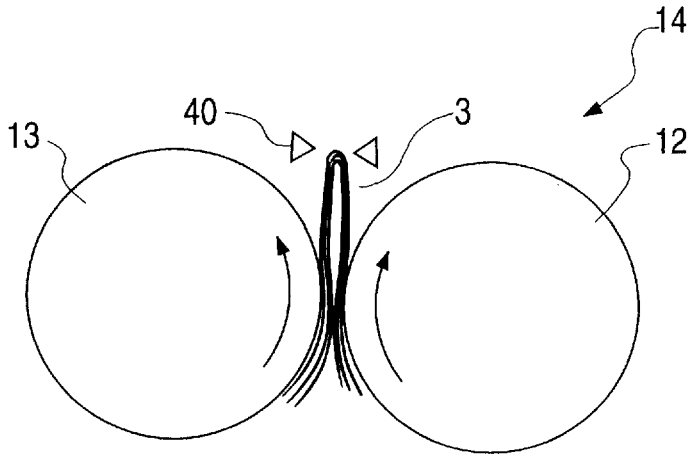
FIG. 9 is an illustration showing the state when the bundle of sheets has arrived at a second predetermined position.

On the other hand, the thus rolled-in bundle of sheets, as shown in FIG. 9, is raised to the second predetermined position, and a signal is inputted from the position sensor 40 which has detected this. Thereupon, the control device 38 stops the fold motor 19 and on the other hand, outputs a drive signal to the protrude motor 36 and the cam motor 27 to thereby reversely rotate the protrude motor 36 for the first predetermined time (T1) and normally rotate the cam motor 27.

When the protrude motor 36 is thus reversely rotated for the first predetermined time (T1), the protrude arm 35 is pivotally moved in the retract direction and the folding bar 16 is retracted downwardly of the supporting table 11. Also, when the cam motor 27 is normally rotated, the cam 25 presses the lower end portion of the pressure varying plate 24, whereby the pressure varying plate 24 is pivotally moved in a direction to pull the coil spring 23 and therewith, the pressing plate 22 is pivotally moved by the spring force of the coil spring 23. When this pressing plate 22 is pivotally moved to the first predetermined position, the first switch 31 is pushed by the pressure varying plate 24 and outputs to the control device 38 a signal indicative of the fact that the pressing plate 22 has been pivotally moved to the first predetermined position. On the basis of this signal, the control device 38 stops the cam motor 27 to thereby hold the pressing plate 22 in the first predetermined position.

Figure 10:
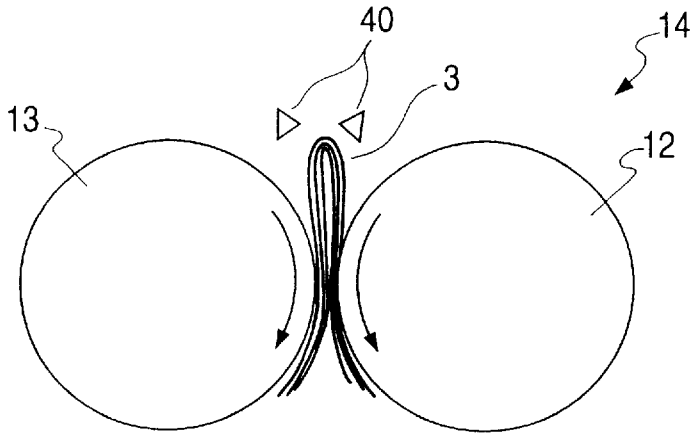
FIG. 10 is an illustration showing the state when the pair of fold rollers has started its reverse rotation.

On the other hand, after having thus held the pressing plate 22 in the first predetermined position, the control device 38 outputs a drive signal to the fold motor 19 to thereby reversely rotate the fold motor 19. Thereby, the fold roller pair 14 is rotated in the return direction indicated by an arrow in FIG. 10, whereby the bundle of sheets 3 so far moved so as to be raised is lowered.

Figure 11:
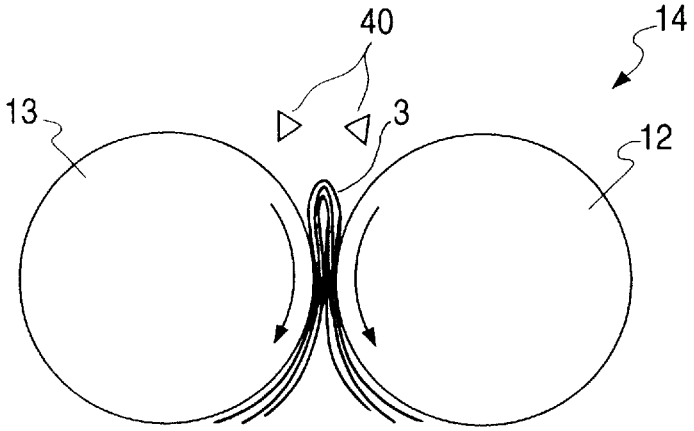
FIG. 11 is an illustration showing the state when the folded portion of the bundle of sheets passes the pair of fold rollers.
Figure 12:
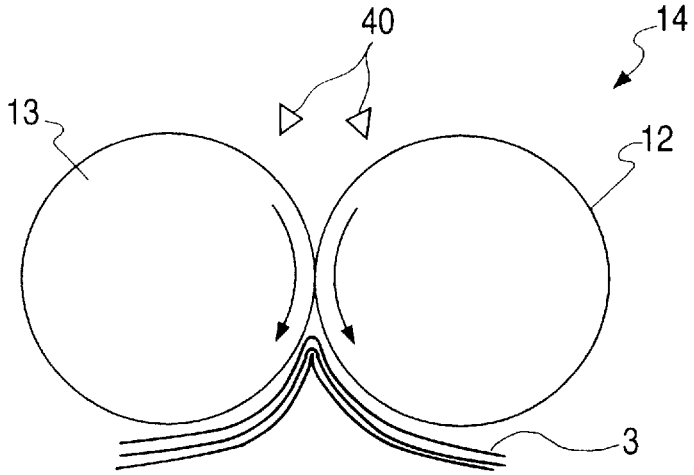
FIG. 12 is an illustration showing the state when the bundle of sheets has been released from the pair of fold rollers.

When the bundle of sheets 3 is thus being lowered, the second roller 13 is in pressure contact with the first roller 12 with the second pressure contact force and therefore, when as shown in FIG. 11, the upper end, i.e., the fold portion, of the bundle of sheets 3 passes the folding roller pair 14, a great pressure force is applied thereto and the state of fold becomes good. When the fold motor 19 is thus reversely rotated for the second predetermined time (T2), the bundle of sheets 3 is liberated from the folding roller pair 14, as shown in FIG. 12, and is returned onto the supporting table 11.

Thereafter, the control device 38 outputs a device signal to the cam motor 27 to thereby reversely rotate the cam 25 so far stopped so as to keep the pressing plate 22 in the first predetermined position, and releases the pressing by the cam 25 to the pressure varying plate 24. Thereby, the pressure varying plate 24 and the pressing plate 22 are returned to their respective normal positions before pivotal movement by the spring force of the coil spring 23 and therewith, the second roller 13 comes into pressure contact with the first roller 12 with the first pressure contact force. When the pressing plate 22 is thus returned to its normal position, the second switch 32 is pushed by the cam 25 and outputs to the control device 38 a signal indicative of the fact that the pressing plate 22 has been returned to its normal position. On the basis of this, the control device 38 stops the cam motor 27, whereby the pressing plate 22 is held in its normal position.

On the other hand, when the detection signal from the second switch 32 is inputted to the control device 38, the control device 38 outputs a drive signal to the protrude motor 36 and the fold motor 19 to thereby normally rotate the fold motor 19 and normally rotate the protrude motor 36 for the first predetermined time (T1). Thereby, the folding bar 16 is protruded from the supporting table 11 and the central portion of the neatly folded bundle of sheets is guided to the fold roller pair 14 by the folding bar 16 and is rolled into the fold roller pair 14.

Also, when the thus rolled-in bundle of sheets is raised to the second predetermined position (see FIG. 9), the signal from the position sensor 40 is inputted to the control device 38. Thus, the control device 38 outputs a drive signal to the protrude motor 36 to thereby reversely rotate the protrude motor 36 for the first predetermined time (T1) and retract the folding bar 16 downwardly of the supporting table 11.

When the second signal is thus inputted from the position sensor 40, the control device 38 continues to normally rotate the fold motor 19 and therefore, the bundle of sheets 3 is neatly folded and is moved to the take-out portion via the paper discharge path 39, and is taken out from this take-out portion. When the bundle of sheets 3 is thus taken out and the signal from the position sensor 40 is no longer inputted, the control device 38 judges that the bundle of sheets 3 has been taken out, and stops the fold motor 19 and prepares for the next folding operation.

As described above, the bundle of sheets 3 is folded with the small first pressure contact force when it is rolled in, whereafter the bundle of sheets 3 is folded with the great pressure contact force when it is returned onto the supporting table 11. Further, thereafter, the bundle of sheets 3 is folded with the first pressure contact force when it is again rolled in, whereby folding pressure can be applied to the bundle of sheets 3 three times and the folded state of the bundle of sheets can be made good.

In the foregoing, description has been made of the apparatus in which the protrude motor 36 is normally rotated for the first predetermined time, whereby the folding bar 16 does not strike against the fold roller pair 14. The present invention, however, is not restricted to it, but a stopper against which the folding bar 16 protruded to the position for guiding the bundle of sheets 3 strikes may be provided, for example, between the supporting table 11 and the fold roller pair 14, whereby the folding bar 16 can be more reliably prevented from striking against the fold roller pair 14. Also, while in the foregoing, the bundle of sheets to be folded has been described as being not stapled on the supporting table 11 in the sheet discharge device 9 after image formation, the present invention is also applicable to a bundle of sheets stapled at the central position thereof.

Another embodiment of the present invention will now be described in detail with reference to the drawings.

Figure 13:
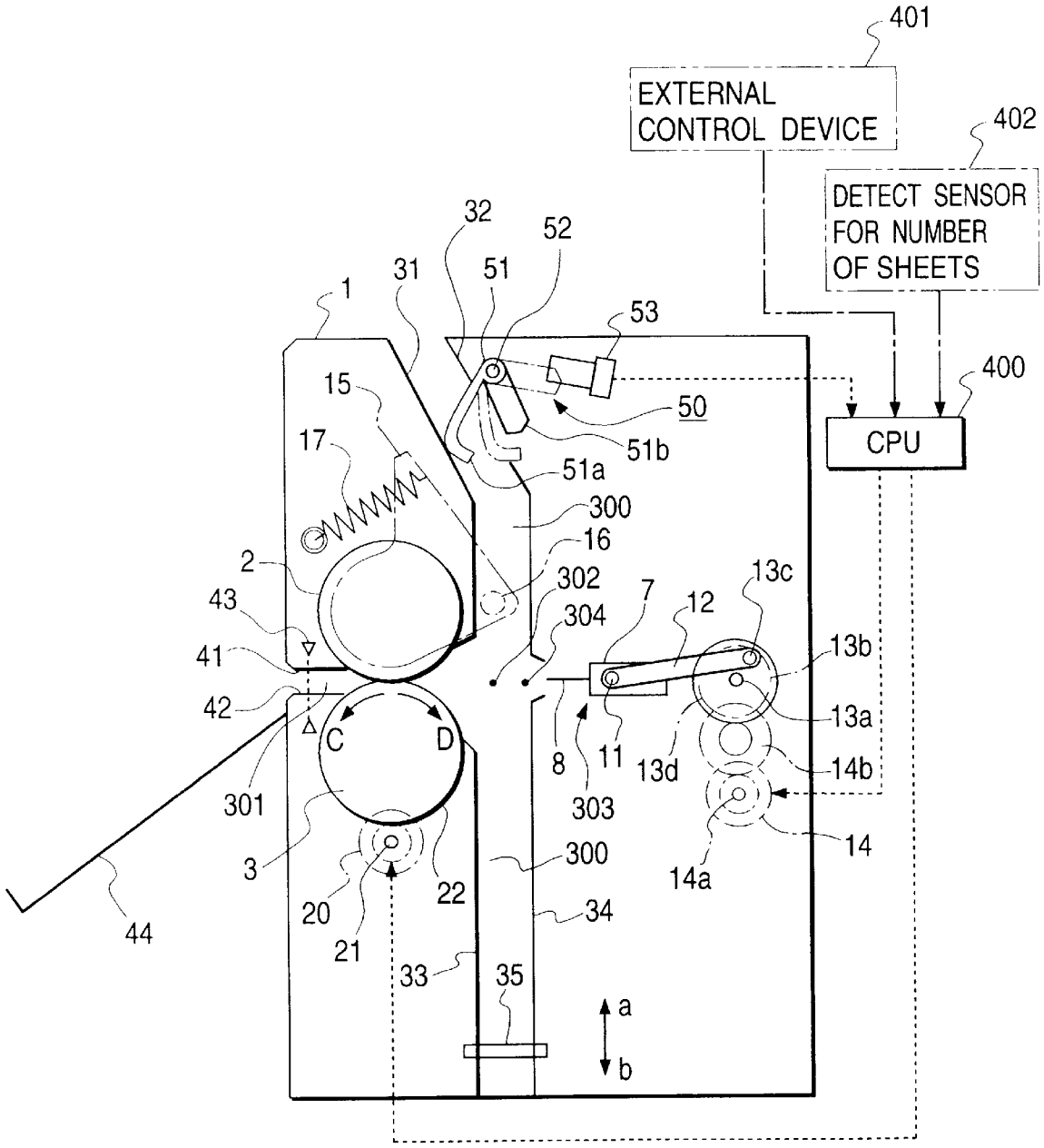
FIG. 13 is a cross-sectional view of a sheet folding apparatus according to another embodiment of the present invention.

FIG. 13 schematically shows the construction of a sheet folding apparatus according to the present embodiment.

As shown in FIG. 13, a frame 1 is formed with entrance guides 31 and 32 for introducing sheets to be treated into the apparatus, and sheet guides 33 and 34 connected to the entrance guides 31 and 32. These entrance guides 31, 32 and sheet guides 33, 34 together constitute a first conveyance path 300.

A second conveyance path 301 branching off from the first conveyance path 300 is formed in the course of the first conveyance path 300, and fold rollers (rotatable members) 2 and 3 are disposed on the branch-off portion 302 side thereof. The fold roller 3 is rotatably mounted on the frame 1 through a bearing, while the fold roller 2 is rotatably mounted on a pressing plate 15 through a bearing. The pressing plate 15 is pivotally movable about a pressing fulcrum 16 secured to the frame 1, and a spring 17 is restrained on one end thereof, and by this spring 17, the pressing plate 15 is normally biased counter-clockwisely about the pressing fulcrum 16. Accordingly, the fold roller 2 is adapted to be pressed against the fold roller 3 by the spring force of the spring 17.

The fold roller 3 has a gear 22 secured coaxially therewith, and this gear 22 is in meshing engagement with the pinion gear 21 of a fold motor (stepping motor) 20. Accordingly, the drive force of the fold motor (rotatable member driving means) is transmitted to the fold roller 3 through the gears 21 and 22.

[Protrude Mechanism]

Sheet protrude means 303 is disposed at a region (disposition portion 304) opposed to the branch-off portion 302 of the sheet guide 34 constituting the first conveyance path 300. This sheet protrude means 303 is provided with a protrude plate 8 protruding from an opening portion 304 to immediately the front of the nip portion between the fold rollers 2 and 3, and is adapted to be held by a protrude plate holding member 7. The protrude plate holding member 7 is adapted to be parallel-moved along a slot formed in the frame 1. Support shafts 11 are secured to the opposite sides of the protrude plate holding member 7, and one end (the left end as viewed in FIG. 13) of a protrude arm 12 is pivotally fitted thereto. A support shaft 13*c* on a protrude drive plate 13*b* is pivotally fitted to the other end (the right end) of the protrude arm 12.

The protrude drive plate 13*b* is disposed in pair in a direction perpendicular to the plane of the drawing sheet of FIG. 13, and is secured to a protrude drive shaft 13*a*, on which a protrude drive gear 13*d* is secured. This protrude drive gear 13*d* is linked to the motor gear 14*a* of a protrude drive motor (stepping motor) 14 through an idle gear 14*b*, and the rotation of the protrude drive motor 14 is reduced and transmitted by the motor gear 14*a* secured on the output shaft of the motor and the idle gear 14*b*. Accordingly, the protrude drive shaft 13*a* is rotated by the rotation of the protrude drive motor 14, whereby the protrude drive plates 13*b* secured to the protrude drive shaft 13*a* are rotated. Thereby, the protrude arm 12 is pivotally moved so that the protrude plate holding member 7 may be parallel-moved (moved toward the nip portion between the fold rollers 2 and 3 as viewed in FIG. 13).

The sheet guides 33 and 34 disposed below the fold rollers 2 and 3 in FIG. 13 have a sheet stopper 35 for regulating the leading end position of the sheet provided on the lower end portions thereof, and the sheet stopper 35 can be slidden in a vertical direction (arrows a and b) as viewed in FIG. 13 by a lever (not shown) protruding outwardly of the apparatus. Consequently, if a user operates the lever in accordance with the size of a sheet to be folded, the sheet stopper will be moved in the direction of arrow a or b in FIG. 13 in conformity with the amount of operation.

Discharge guides 41 and 42 are located at the left side of the fold rollers 2 and 3 as viewed in FIG. 13, and constitute the aforementioned second conveyance path 301. On the atmosphere side (the left side as viewed in FIG. 13) end portion of the discharge guides 41 and 42, there is disposed a discharge sensor 43 comprised of a transmission type photosensor for detecting the passage of the sheets. The folded bundle of sheets guided by the discharge guides 41 and 42 and discharged outwardly of the apparatus may be placed on a discharge tray 44.

[Sheet Bundle Thickness Sensor]

Description will now be made of a sheet bundle thickness sensor (sheet thickness output means) 50 used in the sheet folding apparatus according to the present embodiment.

This sheet bundle thickness sensor 50 is disposed on the opening portion side of the entrance guides 31 and 32 and is adapted to detect the thickness of the bundle of sheets passing between the two guides 31 and 32. This sheet bundle thickness sensor 50 is provided with a sheet bundle thickness sensor flag (lever) 51 protruding into the first conveyance path 300, and a transmission type photosensor (sensor portion) 53, and the sheet bundle thickness sensor flag 51 is pivotally movable about a fulcrum 52. The sheet bundle thickness sensor flag 51 is normally biased clockwisely by a spring (not shown) and one end portion 51*a* thereof protrudes toward the entrance guide 31 side. When the bundle of sheets is inserted between the entrance guides 31 and 32, the sheet bundle thickness sensor flag 51 is pivotally moved in conformity with the thickness of the bundle of sheets. When the bundle of sheets assumes a predetermined thickness or greater, the other end portion 51*b* of the sheet bundle thickness sensor flag 51 interrupts the support shaft of the transmission type photosensor 53 and detects that the bundle of sheets has the predetermined thickness or greater. The detection signal is outputted from the transmission type photosensor 53 to a CPU 400 as control means.

[Folding Operation]

The folding operation for the bundle of sheets will now be described with reference to FIGS. 13, 14A to 14F and 15.

A sheet size lever (not shown) linked to the sheet stopper 35 is firstly operated to thereby move the sheet stopper 35 to a position coincident with the size of the sheets to be folded. When the bundle of sheets to be folded is inserted along the entrance guides 31 and 32, the sheet bundle thickness sensor flag 51 contacts with the bundle of sheets and is pivotally moved, whereby whether the bundle of sheets has the predetermined thickness or greater is detected. Further, the bundle of sheets is guided along the sheet guides 33 and 34 and the leading end thereof strikes against the sheet stopper 35 and thus, the bundle of sheets is stopped.

Figure 14A:
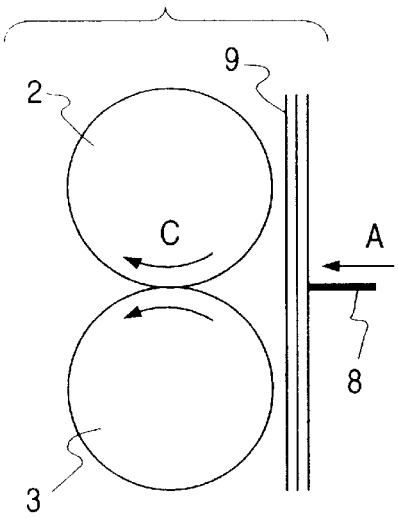

When the setting (placement) of the bundle of sheets onto the first conveyance path 300 is terminated, a start button (not shown) is depressed. The signal of this start button is inputted to the CPU 400, from which a control signal is thus outputted to the protrude drive motor 14 and the fold motor 20, whereby the protrude drive motor 14 and the fold motor 20 begin to be rotated. Since the rotation of the fold motor 20 is transmitted to the fold roller 3, the fold rollers 2 and 3 are rotated in the direction of arrow C in FIG. 14A. Also, the rotation of the protrude drive motor 14 is transmitted to the sheet protrude means 303, whereby the protrude plate 8 is moved in the direction of arrow A and starts the operation of protruding the bundle of sheets 9 toward the fold rollers 2 and 3 side (FIG. 14A).

Figure 14B:
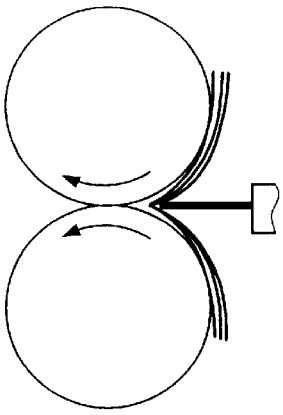

As shown in FIG. 14B, the protrude plate 8 rams the bundle of sheets 9 against the fold rollers 2 and 3 while deforming it into a triangle. Thereupon, by the protruding force applied by the protrude plate 8, there is created a frictional force between the fold rollers 2, 3 and the bundle of sheets and further, due to the rotational forces of the fold rollers 2 and 3, the bundle of sheets 9 comes into the nip between the fold rollers 2 and 3. At that time, the protrude plate 8 bears against the stopper (not shown) and is prevented from moving toward the fold rollers 2 and 3, thus being prevented from coming into the nip between the fold rollers 2 and 3.

If here, the thickness data detected by the sheet bundle thickness sensor 50 is OFF, that is, the thickness of the bundle of sheets is less than the predetermined thickness (S202 in FIG. 15), the fold rollers 2 and 3 are further rotated to thereby discharge the bundle of sheets 9 (S203). The bundle of sheets passes the discharge guides 41 and 42 and is discharged onto the discharge tray 44.

On the other hand, if the thickness data detected by the sheet bundle thickness sensor 50 is ON (S202), that is, the thickness of the bundle of sheets is the predetermined thickness or greater, the following operations are performed. When it is detected by the discharge sensor 43 that the folded bundle of sheets 9 has passed the discharge sensor 43 (FIG. 14D and (S205) in FIG. 15), the rotation of the fold motor 20 is stopped. Thereafter, the fold motor 20 is rotated in the opposite direction (S206) to thereby rotate the fold rollers 2 and 3 in the direction of arrow D indicated in FIG. 14E. When the bundle of sheets 9 passes through the nip between the fold rollers 2 and 3 and is further conveyed by some amount, the rotation of the fold motor 20 is stopped (FIG. 14F).

Figure 14C:
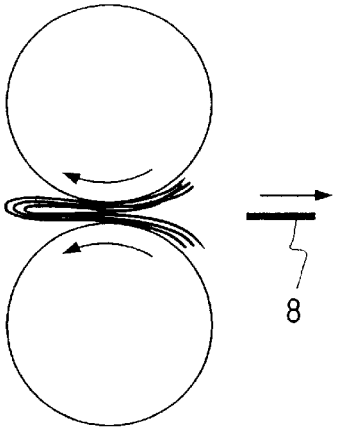
Figure 14D:
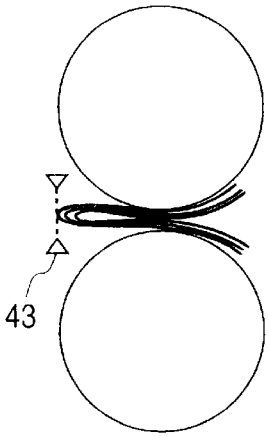
Figure 14E:
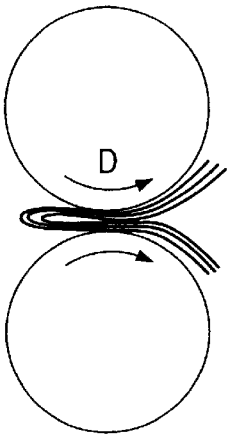
Figure 14F:
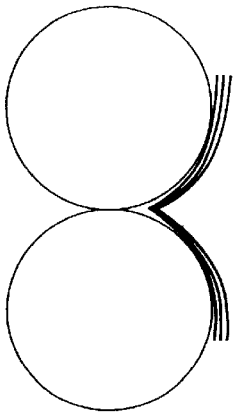
Figure 15:
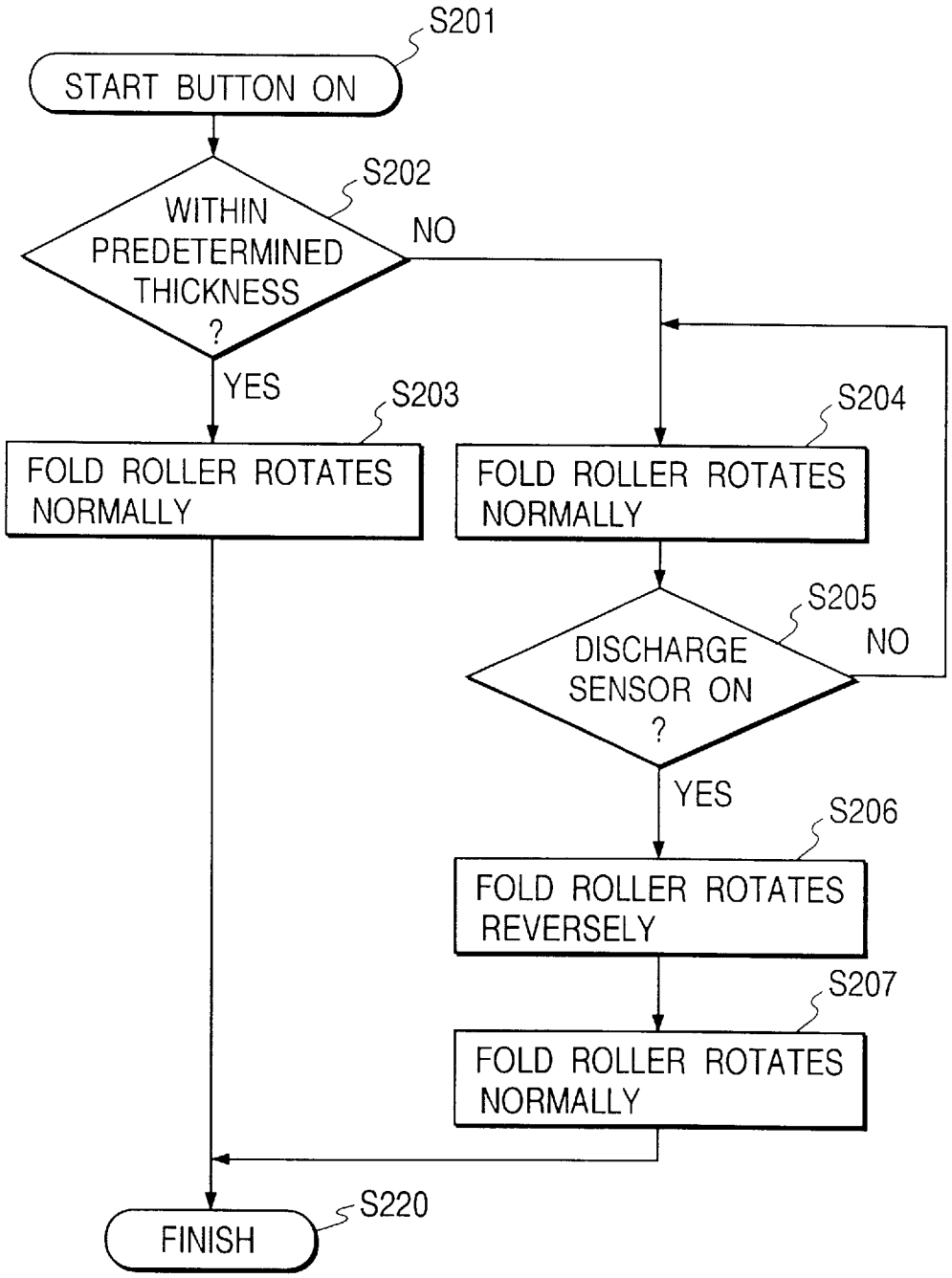
FIG. 15 is a flowchart showing the operational procedures of a sheet folding apparatus according to another embodiment of the present invention.

Thereafter, the operations of FIGS. 14A, 14B and 14C are performed (S207) and the fold motor 20 is rotated by an amount enough for the folded bundle of sheets 9 to be discharged onto the discharge tray 44, whereafter the fold motor 20 is stopped (S220). This fold motor 20 and the protrude drive motor 14 are linked to the CPU 400 as control means so as to be operatively controlled by the CPU 400.

The number of normal and reverse revolutions of the folding rollers may be increased or decreased in conformity with the thickness of the bundle of sheets.

In the present embodiment, the sheet bundle thickness detecting sensor is provided and folding is effected several times depending on the thickness of the bundle of sheets to be folded. However, when the sheet folding apparatus according to the present embodiment is connected to a copying apparatus or a printer and sheets are sent one by one from the copying apparatus or the like to the sheet folding apparatus, sheet number information sent from the outside control device (sheet thickness output means) 401 of the copying apparatus or the like may be utilized. Or, instead of the sheet bundle thickness detecting sensor, a sheet number detecting sensor (sheet thickness output means) 402 may be provided to convert the number of sheets to be folded into a thickness and determine the frequency of folding.

Further, before the folding process for the bundle of sheets in the present embodiment, it is also possible to dispose sheet binding means capable of stapling substantially at the center of a bundle of sheets to be folded, carry out the aforedescribed folding of the bundle of sheets after binding the bundle of sheets, and make a double-spread pamphlet.

[Image Forming Apparatus]

Figure 16:
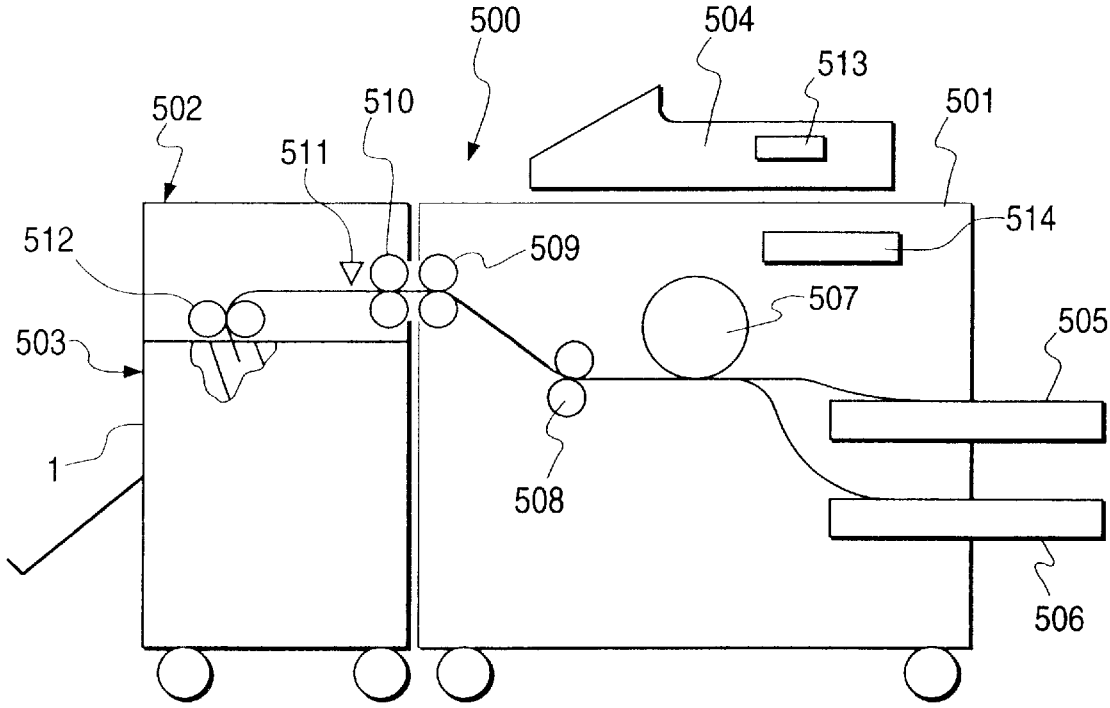
FIG. 16 is a schematic view showing the construction of an image forming apparatus provided with another sheet folding apparatus according to the present invention.
Figure 17:
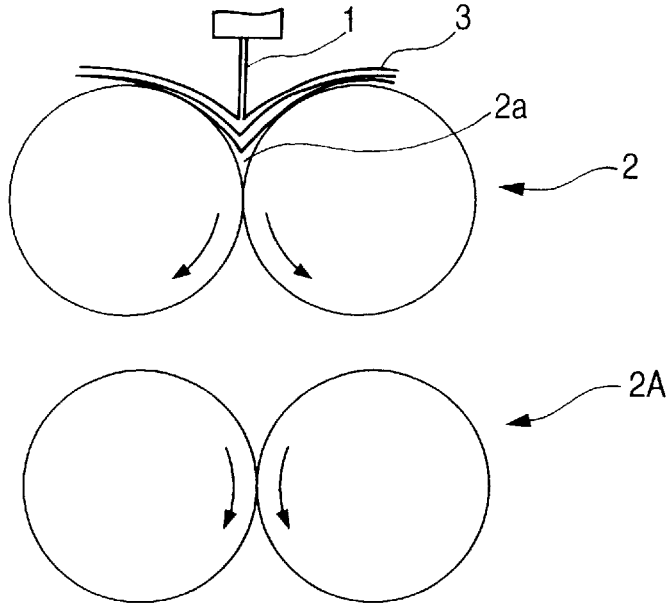
FIG. 17 RELATED ART
FIG. 17 shows prior art.

FIG. 16 shows an image forming apparatus 500 using the above-described sheet folding apparatus, and the sheet folding apparatus 503 of the present invention is connected to an image forming apparatus body 501. The sheet folding apparatus 503 has an accessory apparatus 502 for sheet introduction mounted on the upper portion of the frame 1.

Such an image forming apparatus 500 forms images on sheets fed out of a cassette 505 or a cassette 506 in an image forming portion 507, and feeds out the sheets having the image formed thereon to the accessory apparatus 502 side by conveying rollers 508 and discharge rollers 509. The accessory apparatus 502 receives the sheets by introducing rollers 510, and counts the number of the sheets by sheet number counter means 511, whereafter it feeds the sheets into the sheet folding apparatus 503 for folding the sheets by guide rollers 512.

An automatic original feeding device 504 is mounted on the upper portion of the image forming apparatus body 501, and original counter means 513 is disposed therein. A copy number setting button 514 is mounted on the image forming apparatus body 501.

The above-described form is one in which the sheet folding apparatus 503 is used in combination with the image forming apparatus body 501 so as to automatically carry out the sheet folding process. However, the sheet folding apparatus 503 can also be used singly, and the accessory apparatus 502 will be unnecessary if design is made such that the first conveyance path 300 of the sheet folding apparatus 503 opens into the sheet discharge portion of the image forming apparatus body 501.

What is claimed is:

1. A sheet bundle folding apparatus for causing a bundle of sheets to be rolled into a pair of fold rollers to thereby fold the bundle of sheets, comprising:

drive means for rotating said pair of fold rollers in a normal direction to roll the bundle of sheets thereinto, a reverse direction to return the rolled bundle of sheets, and then in the normal direction to pass the folded bundle of sheet therethrough.

2. A sheet bundle folding apparatus according to claim 1, wherein a pressure contact force of said pair of fold rollers is set in an ordinary magnitude, when said pair of fold rollers are rotated in the normal direction, and it is set greater than the ordinary magnitude when said pair of fold rollers are rotated in the reverse direction.

3. A sheet bundle folding apparatus according to claim 1 or 2, wherein position detecting means for detecting the arrival of said rolled-in bundle of sheets at a predetermined position is provided near said pair of fold rollers, so that said pair of fold rollers are rotated in the reverse direction on the basis of a detection signal therefrom.

4. A sheet bundle folding apparatus according to claim 1, further comprising:

a supporting table on which the bundle of sheets is placed;

protrude means for pushing the bundle of sheets on said supporting table to feed the bundle of sheets into a nip between said pair of fold rollers; and control means for controlling said protrude means so as to protrude a folding piece from said supporting table when said pair of fold rollers are rotated in the normal direction, and to retract said folding piece from said supporting table when said pair of fold rollers are rotated in the reverse direction.

5. A sheet bundle folding apparatus according to claim 4, wherein said pair of fold rollers are comprised of a fixed roller and a pivotally movable moving roller brought into pressure contact with said fixed roller, and said apparatus is further provided with pivotally moving means for pivotally moving said moving roller so as to change the pressure contact force thereof with said fixed roller, and control means for controlling said pivotally moving means so as to set the pressure contact force into an ordinary magnitude when said pair of fold rollers are rotated in the normal direction, and to set the pressure contact force greater when said pair of fold rollers are rotated in the reverse direction.

6. A sheet bundle folding apparatus according to claim 5, further comprising:

path means for guiding the bundle of sheets between said pair of fold rollers and said protrude means; and stop means for checking an end in the feeding direction of the bundle of sheets so that a substantially central portion of the bundle of sheets as viewed in the feeding direction thereof opposes to said protrude means.

7. A sheet bundle folding apparatus according to claim 1, further provided with:

sheet thickness information means; and control means for controlling said drive means in conformity with sheet thickness information by said information means, and rotating said pair of fold rollers in the normal direction and the reverse direction when the thickness of the bundle of sheets is equal to or greater than a predetermined thickness, and rotating said pair of folded rollers in the normal direction to roll the bundle of sheet thereon and to pass therethrough when the thickness of the bundle of sheet is not equal to or greater the predetermined thickness.

8. A sheet bundle folding apparatus according to claim 1, further provided with sheet thickness information means; and control means for increasing or decreasing the number of normal and reverse rotations of said pair of fold rollers in conformity with sheet thickness information by said information means.

9. A sheet bundle folding apparatus according to claim 7 or 8, wherein said sheet thickness information means is a sheet thickness detecting sensor.

10. A sheet bundle folding apparatus according to claim 7 or 8, wherein said sheet thickness information means is sheet number detecting means.

11. A sheet bundle folding apparatus according to claim 7 or 8, wherein said sheet thickness information means is sheet thickness or sheet number input means.

12. A sheet bundle folding apparatus according to claim 7 or 8, further provided with sheet binding means for binding the sheets at a predetermined position thereof.

13. An image forming apparatus provided with a sheet bundle folding apparatus according to one of 1, 2, 7 and 8; and an image forming portion for forming images on the sheets to be treated by said sheet bundle folding apparatus.

14. A sheet bundle folding apparatus for causing a bundle of sheets to be rolled into a pair of fold rollers to thereby fold the bundle of sheets, comprising:

driving means having a first mode for rotating said pair of fold rollers in a normal direction to roll the bundle of sheets thereinto and to pass therethrough, and a second mode for rotating said pair of fold rollers in a normal direction to roll the bundle of sheets thereinto in a reverse direction to return the bundle of sheets, and then in a normal direction to pass the folded bundle of sheets therethrough.

15. A sheet bundle folding apparatus according to claim 14, wherein the first mode of said driving means is selected when the thickness of the sheet bundle is equal to or smaller than the predetermined thickness.

16. A sheet bundle folding apparatus according to claim 14, wherein the first mode of said driving means is selected when the number of sheets of the sheet bundle is equal to or less than a predetermined number.

17. A sheet bundle folding apparatus according to claim 14, wherein a depressing force of the sheet bundle by said pair of fold rollers is greater than upon reverse rotation of said pair of fold rollers than that upon normal rotation thereof.

18. A sheet bundle folding apparats according to claim 14, further comprising:

a supporting table on which the bundle of sheets is placed;

protrude means for pushing the bundle of sheets on said supporting table to feed the bundle of sheets into a nip between said pair of fold rollers.

19. A sheet bundle folding apparatus according to claim 18, further comprising control means for controlling said protrude means so as to protrude a folding piece from said supporting table when said pair of fold rollers are rotated in the normal direction, and to retract said folding piece from said supporting table when said pair of fold rollers are rotated in the reverse direction.

20. A sheet bundle folding apparatus according to claim 18, further comprising:

path means for guiding the bundle of sheets between said pair of folded rollers and said protrude means; and stop means for checking an end in the feeding direction of the bundle of sheets so that a substantially central portion of the bundle of sheets as viewed in the feeding direction thereof opposes to said protrude means.

* * * * *

UNITED STATES PATENT AND TRADEMARK OFFICE

CERTIFICATE OF CORRECTION

PATENT NO. : 5,876,027 Page 1 of 2

DATED : March 2, 1999

INVENTOR(S) : AKIRA FUKUI, ET AL.

It is certified that error appears in the above-identified patent and that said Letters Patent is hereby corrected as shown below:

COVER PAGE AT ITEM [56] U.S. PATENT DOCUMENTS,
"Reis et al." should read --Ries et al.--.

COLUMN 1,
Line 16, "as" should read --is--; and
Line 63, "of" should read --of a--.

COLUMN 2,
Line 2, "sheet" should read --sheets--.

COLUMN 3,
Line 18, "small" should read --less--.

COLUMN 4,
Line 42, "arrow," should read --arrow A,--; and
Line 49, "to be" should be deleted.

COLUMN 15,
Line 20, "sheet" should read --sheets--.

COLUMN 16,
Line 8, "folded" should read --fold--;
Line 9, "sheet" should read --sheets--;
Line 10, "sheet" should read --sheets--;
Line 11, "greater" should read --greater than--;

UNITED STATES PATENT AND TRADEMARK OFFICE

CERTIFICATE OF CORRECTION

PATENT NO. : 5,876,027 Page 2 of 2

DATED : March 2, 1999

INVENTOR(S) : AKIRA FUKUI, ET AL.

It is certified that error appears in the above-identified patent and that said Letters Patent is hereby corrected as shown below:

COLUMN 16

Line 32, "of 1," should read --of claims 1,--;

Line 61, "apparats" should read --apparatus--.

Signed and Sealed this

Fifth Day of October, 1999

*Attest:*

*Attesting Officer*

Q. TODD DICKINSON

*Acting Commissioner of Patents and Trademarks*